US005306590A

United States Patent [19]

Felder

[11] Patent Number: 5,306,590

[45] Date of Patent: Apr. 26, 1994

[54] HIGH SOLIDS LIQUID DEVELOPER CONTAINING CARBOXYL TERMINATED POLYESTER TONER RESIN

[75] Inventor: Thomas Felder, Pannal, England

[73] Assignee: Xerox Corporation, Stamford, Conn.

[21] Appl. No.: 812,678

[22] Filed: Dec. 23, 1991

[51] Int. Cl.[5] ..... G03G 9/125

[52] U.S. Cl. ..... 430/115; 430/137

[58] Field of Search ..... 430/114, 115, 137

[56] References Cited

U.S. PATENT DOCUMENTS

| | | | |
|---|---|---|---|
| 2,899,335 | 8/1959 | Straugham | 117/37 |
| 3,397,254 | 8/1968 | Wynstra et al. | 260/835 |
| 3,900,412 | 8/1975 | Kosel | 96/1 |
| 3,900,512 | 8/1975 | Sih | 260/51 |
| 3,963,486 | 6/1976 | Tamai et al. | 427/16 |
| 3,968,044 | 7/1976 | Tamai et al. | 252/62.1 |
| 3,998,747 | 12/1976 | Yamakami et al. | 252/62.1 |
| 4,052,325 | 10/1977 | Santilli | 252/62.1 |
| 4,134,881 | 1/1979 | Cuddihy et al. | 260/75 |
| 4,157,974 | 6/1979 | Brechlin et al. | 252/62.1 |
| 4,202,785 | 5/1980 | Merrill et al. | 430/106 |
| 4,275,189 | 6/1981 | Danick et al. | 528/296 |
| 4,484,333 | 11/1984 | Hikake et al. | 241/5 |
| 4,507,377 | 3/1985 | Alexandrovich | 430/115 |
| 4,543,313 | 9/1985 | Mahabadi et al. | 430/109 |
| 4,557,991 | 12/1985 | Takagiwa et al. | 430/109 |
| 4,631,244 | 12/1986 | Mitchell | 430/137 |
| 4,659,640 | 4/1987 | Santilli | 430/119 |
| 4,702,984 | 10/1987 | El-Sayed et al. | 252/62.1 |
| 4,702,985 | 10/1987 | Larson | 430/115 |
| 4,707,429 | 11/1987 | Trout | 430/115 |
| 4,734,352 | 3/1988 | Mitchell | 430/115 |
| 4,740,444 | 4/1988 | Trout | 430/137 |
| 4,740,580 | 4/1988 | Merck et al. | 528/272 |
| 4,812,377 | 3/1989 | Wilson et al. | 430/109 |
| 4,833,057 | 5/1989 | Misawa et al. | 430/109 |
| 4,844,349 | 7/1989 | Kanda et al. | 241/79.1 |
| 4,859,560 | 8/1989 | Nakamura et al. | 430/137 |
| 4,877,704 | 10/1989 | Takagiwa et al. | 430/99 |
| 4,900,647 | 2/1990 | Hikake et al. | 430/137 |
| 4,917,309 | 4/1990 | Zander et al. | 241/5 |
| 4,923,778 | 5/1990 | Blair et al. | 430/137 |
| 4,925,763 | 5/1990 | Tsubuko et al. | 430/106 |
| 4,930,707 | 6/1990 | Oshiro et al. | 241/5 |
| 4,935,252 | 6/1990 | Nishikawa et al. | 430/109 |
| 4,935,327 | 6/1990 | Takizawa et al. | 430/110 |
| 4,966,825 | 10/1990 | Suzuki et al. | 430/137 |
| 4,981,923 | 1/1991 | Hagiwara et al. | 525/440 |
| 4,988,600 | 1/1991 | Jongewaard et al. | 430/115 |
| 4,988,602 | 1/1991 | Kok et al. | 430/110 |
| 5,006,441 | 4/1991 | Kato | 430/114 |
| 5,006,612 | 4/1991 | Danick et al. | 525/438 |
| 5,017,451 | 5/1991 | Larson et al. | 430/137 |
| 5,037,715 | 8/1991 | Hagiwara et al. | 430/109 |

*Primary Examiner*—John Goodrow
*Attorney, Agent, or Firm*—Oliff & Berridge

[57] ABSTRACT

A high solids replenishable electrostatic liquid developer concentrate includes toner particles containing a carboxyl terminated polyester resin and a pigment and a liquid toner dispensant. The solids content of the concentrate is above about 50%. A method for producing the concentrate includes the steps of blending particles containing a carboxyl terminated polyester and a pigment with a liquid toner dispersants to form a toner dispersant mixture and to increase the solids content of the toner dispersant mixture to more than about 90% solids. Toner solids in a liquid electrostatic developer are replenished by adding the toner particles to a toner solids depleted liquid electrostatic developer in a liquid electrostatographic printing machine.

28 Claims, No Drawings

HIGH SOLIDS LIQUID DEVELOPER CONTAINING CARBOXYL TERMINATED POLYESTER TONER RESIN

FIELD OF THE INVENTION

The present invention relates to a high solids replenishable liquid electrostatic developer and a method for making the developer.

BACKGROUND

An electrostatographic printing machine such as a photocopier, laser printer, facsimile machine or the like employs an imaging member that is exposed to an image to be printed. Exposure of the imaging member records an electrostatic latent image on it corresponding to the informational areas contained within the image to be printed. The latent image is developed by bringing a developer material into contact therewith. The developed image is transferred to a support material such as paper either directly or via an intermediate transport member. The developed image on the support material is generally subjected to heat and/or pressure to permanently fuse it thereto.

Many types of developer compositions, including both dry developer compositions and liquid developer compositions, have been proposed for use in the development of latent electrostatic images. Dry developer compositions typically suffer from the disadvantage that distribution of the dry toner powder contained therein on the surface of the element bearing the latent image is difficult to control. These dry developers have the further disadvantage that the use thereof may create excessive amounts of dust and that high resolution is often difficult to obtain due to the generally relatively large size of the dry developer powder particles.

Many of the disadvantages accompanying the use of dry developer compositions have been avoided by the use of liquid developers. Liquid developers have a number of advantages over the use of dry developers. Because liquid developers contain smaller toner particles than dry developers, they produce higher resolution images. As liquid developers are pumped through tubing within the machines there are no dusting problems that commonly arise with the use of dry developers. Additionally, because liquid developers are not tribocharged, they are less sensitive to humidity. Liquid developers are usually comprised of an electrically insulating liquid which serves as a carrier and which contains a stable dispersion of charged particles known as toner particles comprising a pigment such as carbon black, generally associated with a resinous binder, such as, for example, an alkyd resin. A charge control agent is often included to stabilize the magnitude and polarity of the charge on the toner particles. In some cases, the binder itself serves as a charge control agent. Liquid developers can also have soluble ionic material in solution known as charge directors which impart a charge on the toner particles.

To achieve suitable physical stability of the toner particles dispersed in conventional liquid electrographic developers, any of several types of various "stabilization" additives are incorporated to prevent the toner particles from settling out of the carrier liquid. However, stabilized liquid developer compositions tend to become "deactivated" within a few weeks and the toner particles tend to agglomerate or settle out of the developer. Consequently, the resultant liquid developer composition containing conventional liquid developer toner particles tends to become incapable of producing electrostatic prints of good quality and density. Once the toner particles settle out of the developer suspension, it is often difficult to redisperse them, and, even if redispersed, it is often found that the redispersed liquid developer does not possess the same developer characteristics as the original developer.

Because stabilization in liquid developers has been and is still a difficult problem to overcome, liquid developers are often prepared in the form of so-called "concentrates", i.e., mixtures of resins, pigments and/or dyes with a low liquid content. (See Santilli, U.S. Pat. No. 4,052,325.) These concentrates are stable and exhibit a relatively long shelf life. The loss of stability which occurs in conventional liquid developers, as noted hereinabove, occurs primarily in the diluted form of the concentrate which is the "working" form of the developer, i.e., the form of developer composition actually used in most electrographic developing processes.

Stability in "working" liquid developer compositions may be improved to some extent by the use of the various stabilization agents disclosed in U.S. Pat. No. 2,899,335 (York). These additives are most effective in a developer when used in conjunction with toner particles having a very small particle size. However, even in these situations where stability is achieved in working developers, this stability is often accompanied by too high a developer sensitivity which tends to result in a high degree of background density in the resultant liquid developed electrographic images.

Another problem associated with conventional "stabilized" liquid developers has been the problem of replenishment. Once the developer is used to produce a number of developed images, the developer becomes depleted of toner particles and must be replenished.

In addition to the "stabilized" liquid developers described above, various "redispersible" liquid developers have been formulated which are characterized by toner particles which, upon settling out of suspension with the liquid carrier vehicle of the developer, are readily redispersed in the liquid carrier and, when so redispersed, exhibit developer characteristics similar to the original developer. However, various problems still exist with many of these "redispersible" developers. For example, the toner particles of many of these developers cannot be readily fixed, except to rough-surfaced toner image receiving sheets such as conventional zinc oxide coated papers, using preferred fixing temperatures of about 100° C. or less. These developers, therefore, cannot be employed, except with further binder addenda, in various transfer processes because these processes use smooth surfaced toner-image receiving elements, such as dielectric resin-coated papers, i.e. papers coated with a film-forming dielectric resin. Still other available redispersible developers, although redispersible at ordinary room temperatures, exhibit pronounced caking or agglomeration of the toner particles when subjected to extended periods of storage (e.g., 24 hours) at temperatures above room temperature, and cannot be readily dispersed.

U.S. Pat. No. 4,052,325 (Santilli) discloses a liquid developer containing heat-fixable toner particles, wherein the toner particles contain a linear polyester polymer. The polyester polymer may have a structural formula as follows:

$$\left(O-R-O-\overset{O}{\overset{\|}{C}}-R'-\overset{O}{\overset{\|}{C}}\right)_{100-x}\left(O-R^2-O-\overset{O}{\overset{\|}{C}}-R^3-\overset{O}{\overset{\|}{C}}\right)_x$$

Diols and dicarboxylic acids may be used to prepare the polyester polymer. The diols may include aliphatic, alicyclic, and aromatic diols such as bisphenols, alkylene glycols or monocyclic and polycyclic diols. The dicarboxylic acids may include aliphatic, alicyclic and aromatic dicarboxylic acids, acid anhydrides and acid halide salts. A process of preparing the liquid developer comprises the steps of: (1) dissolving the polyester polymer in a suitable solvent in a ball mill wherein a pigment or other additives may be added forming a polymer-solvent mixture; (2) separating the mixture from the milling beads and the solvent; and (3) grinding the resulting dry polymer-containing material in a ball mill with a small amount of a liquid carrier vehicle creating a developer concentrate.

U.S. Pat. No. 4,659,640 (Santilli) discloses a liquid electrographic developer containing polyester based toner particles and special waxes. Preferred polyester binders have recurring diacid-derived units having the formula:

$$-O-G^1-O-$$

wherein $G^1$ represents straight or branched-chain alkylene having about 2 to 12 carbon atoms or cycloalkylene, cycloalkylenebis(oxyalkylene) or cycloalkylene-dialkylene; and aliphatic, alicyclic or aromatic dicarboxylic acid recurring units which preferably contain sulfur. A process of preparing the liquid developer comprises the steps of: (1) melt-blending the polyester binder and a wax at a temperature above the melting temperature of the amorphous polyester; (2) cooling the blend; (3) pulverizing the blend; and (4) dispersing the blend in a volatile carrier.

U.S. Pat. No. 4,812,377 (Wilson et al.) discloses dry or liquid developers having finely divided toner particles comprising a fusible branched chain polyester resin which contains 2,3,-dihydro,1,3-dioxo-2-yl-1H-isoindole-ar(yl or -diyl) groups as chain capping or backbone groups of the polyester. The toner compositions can be ground to a very small particle size. The polyesters for the toner compositions are prepared by polymerization of polyester monomers such as dicarboxylic acids and diols. The diols may include neopentyl glycol. The polyester may include various polyols to create a polyester branching chain. Branching may be created by including polyols with the polyester monomers. These may include, e.g., trimellitic anhydride. A process of preparing the solid polyester polymer composition comprises the steps of: (1) crushing the polymer and then melt-blending with a colorant; (2) cooling and solidifying the blended composition; (3) crushing and coarsely grinding the composition in a mechanical mill; and (4) pulverizing the coarsely ground composition to a desired small toner particle size.

U.S. Pat. No. 5,006,441 (Kato) discloses a liquid developer comprising a resin dispersed in a non-aqueous solvent, wherein the resin is a copolymer resin obtained by polymerizing a solution containing at least one monofunctional monomer and at least one resin which is a polymer having at least a recurring unit having a formula:

$$\left(CH-\underset{\underset{X^1-R^\circ}{|}}{\overset{\overset{a^1}{|}}{C}}\overset{\overset{a^2}{|}}{}\right)$$

wherein $X^1$ represents —COO—, —OCO—, —$CH_2$OCO—, $CH_2$COO—, —O—, —$SO_2$—, $R^\circ$ represents a hydrocarbon group having from 6 to 32 carbon atoms and $a^1$ and $a^2$, which may be the same or different, each represents a hydrogen atom, a halogen atom, a cyano group, a hydrocarbon group having from 1 to 8 carbon atoms, or —COO—$Z^1$ or —COO $Z^1$ bonded via a hydrocarbon group having from 1 to 18 carbon atoms (wherein $Z^1$ represents a hydrogen atom or a hydrocarbon group having from 1 to 18 carbon atoms). The monomers used in forming the resin may include a polyhydric alcohol such as neopentyl glycol.

Currently envisioned liquid developer printing machines require high solids replenishment to minimize the buildup of excess liquid carrier in the machine. This is because the liquid carrier and the toner are depleted at uneven rates depending on the amount of toner solids taken by each image, the degree to which carrier fluid imbibes into toner solids, the rate at which the paper or receiver sheet absorbs carrier fluid, and the rate at which carrier fluid is lost by evaporation. Theoretically, all carrier fluid is permanently contained in the printing machine and steps are taken to eliminate carrier losses.

Where image density is high, large quantities of toner solids are used while fluid loss is virtually zero. As toner solids are depleted, the volume of the bath changes negligibly. Replenishing the bath with toner concentrate at 10% solids, for example will cause the volume of the bath to grow very quickly, since 9 parts fluid are being added with every one part solids. Every added liter of concentrate causes the bath volume to grow nearly one liter. Consequently, the excess fluid must be removed, at considerable expense. As the efficiency of carrier fluid containment increases, it becomes necessary to replenish the developer with concentrates of increasingly higher concentration to prevent bath growth. However, desirably high concentrations have not previously been attained.

U.S. Pat. No. 3,397,254 (Wynstra et al.) (hereby incorporated by reference) discloses carboxyl terminated polyesters made by reacting a hydroxyl terminated polyester with a tricarboxylic acid anhydride. The hydroxyl-terminated polyester is a reaction product of a dicarboxylic cyclic acid or anhydride thereof and a dihydric compound. The dicarboxylic cyclic acid has the formula:

$$R(COOH)_2$$

wherein R is a cyclic hydrocarbon radical having at least 4 carbon atoms and includes terephthalic acid, isophthalic acid, and cyclohexane dicarboxylic acid and anhydrides thereof. The dihydric compound is a glycol, phenol, cycloaliphatic diol, or ether diol and includes ethylene glycol, butane diol, and neopentyl glycol. The hydroxyl-terminated polyester is prepared by admixing the monomers such that the dihydric compound is present in stoichiometric excess. The tricarboxylic acid anhydride includes trimellitic acid anhydride. The product has a degree of polymerization of at least 3 and a carboxyl functionality of at least three.

U.S. Pat. No. 4,275,189 (Danick) (hereby incorporated by reference) discloses thermosetting powder coating resins having good wear resistance comprising an oligomer of neopentyl glycol or cyclohexane dimethanol, and terephthalic acid, isophthalic acid or dimethyl terephthalate. The oligomer is reacted with trimellitic anhydride to provide a trimellitate. The trimellitate is reacted with a dicarboxylic anhydride or acid to form a thermosetting crosslinkable resin with defined viscosity and acid values.

U.S. Pat. No. 5,006,612 (Danick et al.) (hereby incorporated by reference) discloses powder coating compositions made of linear polyesters which have a carboxylated polyester resin comprising a reaction product of an aliphatic dicarboxylic acid which has 2 to 9 carbon atoms, and a first hydroxyl terminated polyester. The first polyester is a reaction product of not more than about 53 weight percent, based upon a reaction mixture for the first polyester, of terephthalic or isophthalic acid or mixtures thereof, and neopentyl glycol and/or cyclohexane dimethanol. After the carboxylated polyester is formed, it is allowed to cool and solidify. The solidified resin is crushed or granulated and blended in an extruder with a polyepoxide, pigments and other additives to provide a mixture. The mixture is then cooled, crushed, finely ground and sieved. The carboxylated polyester resins are crosslinked in use by heating or baking with an epoxy resin.

U.S. Pat. No. 4,740,580 (Merck et al.) discloses a process of preparing carboxyl group-terminated polyesters for a powdered thermosetting coating composition suitable for application as paint or varnish on electricity conducting articles by electrostatic powder spray methods and fluidized bed coating processes. The carboxyl group terminated polyester is homogeneously mixed with an epoxy compound containing at least two epoxy groups. The process comprises the step of reacting in one step at elevated temperatures terephthalic acid and at least one dihydric aliphatic compound and optionally an aromatic polycarboxylic acid having three or more carboxyl groups and/or a polyhydric organic compound having three or more hydroxyl groups and/or linear aliphatic or cycloaliphatic dicarboxylic acid. The dihydric aliphatic compound may be neopentyl glycol. The resulting carboxyl group-terminated polyester is then cast into a thick layer and allowed to cool. The cooled carboxyl group terminated polyester is ground to give particles. The carboxyl group-terminated polyester particles are cross-linked with epoxy resins which are homogeneously mixed in a kneader or a twin screw extruder. The extruded mixture is ground and sieved. Other substances may be added to the mixture such as pigments and flow control agents

SUMMARY OF THE INVENTION

An object of this invention is to provide a liquid electrostatic developer which is suited to the requirements of a printing machine having extremely efficient carrier fluid containment. It is thus an object of this invention to provide an electrostatic liquid developer which is readily replenished by a high solids liquid developer concentrate in which little energy is required to break apart agglomerated particles. Further objects of the invention include providing a method for making an electrostatic liquid developer which entraps reduced levels of carrier fluid in the developed image, transfers electrostatically from photoreceptor to receiver without placing rigorous tolerances on the electrostatic settings of the hardware, produces high resolution images, and functions in a full color system.

These and other objects are achieved by the invention of a high solids replenishable electrostatic liquid developer concentrate and liquid electrostatic developer, comprising a carboxyl terminated resin and a liquid carrier. The solids content of the developer concentrate or liquid dispersant can be greater than about 50% and preferably greater than about 90%.

DETAILED DESCRIPTION OF PREFERRED EMBODIMENTS

Containment of carrier fluid will be an important feature of currently envisioned liquid toner printing machines. It is sought to develop a machine which will operate as a completely closed system, and will eliminate operator handling of carrier fluid. Consequently, it will be necessary to have a high solids replenishable developer Since the cost of removing waste toner dispersant is considerable in liquid developer based printing machines, high solids replenishment is an important feature to eliminate bath growth.

Current developers can only be concentrated to about 50% solids, beyond which redispersion is extremely difficult. The liquid developer concentrate of this invention can have a toner solids concentration in the range of at least about 90% up to about 100%, and can be redispersed with about five minutes of sonication to working strength concentration. This invention provides a high solids replenishable electrostatic developer concentrate comprising toner particles containing a carboxyl terminated polyester and a colorant blended with a liquid toner dispersant. The carboxyl terminated polyester is a reaction product of a dicarboxylic acid and a glycol. The developer concentrate may be further comprised of a charge director and have a solids content above 50% and preferably above 90%.

The preferred toner dispersant of the invention is a non-polar liquid having a kauri-butanol value of less than 30. Preferably, it is a branched-chain aliphatic hydrocarbon. More particularly, a non-polar liquid of the Isopar ® series may be used in the present developers. These hydrocarbon liquids are narrow cuts of isoparaffinic hydrocarbon fractions with extremely high levels of purity. For example, the boiling range of Isopar ®G is between 157° C. and 176° C.; Isopar ®H is between about 176° C. and 191° C.; Isopar ®K is between about 177° C. and 197° C.; Isopar ®L is between 188° C. and 206° C.; Isopar ®M is between 207° C. and 254° C.; and Isopar ®V is between 254.4° C. and 329.4° C. Isopar ®L has a mid-boiling point of approximately 194° C. Isopar ®M has an auto ignition temperature of 338° C. Isopar ®G has a flash point of 40° C. as determined by the tag closed cup method; Isopar ®H has a flash point of 53° C. as determined by the ASTM D-56 method; Isopar ®L has a flash point of 61° C. as determined by the ASTM D-56 method and Isopar ®M has a flash point of 80° C. as determined by the ASTM D-56 method and an auto-ignition temperature of 338° C. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15 (Exxon Corporation) may also be used. They have flash points of 69° C., 93° C. and 118° C., respectively, and have auto-ignition temperatures of 204° C., 210° C. and 210° C., respectively.

Formation of preferred carboxyl terminated resins which may be used in the present invention is described in U.S. Pat. No. 3,397,254 (Wynstra et al.) which discloses carboxyl terminated polyesters made by reacting a hydroxyl terminated polyester with a tricarboxylic acid anhydride. The hydroxyl-terminated polyester is a reaction product of a dicarboxylic cyclic acid or anhydride thereof and a dihydric compound. The dicarboxylic cyclic acid has the formula:

$$R(COOH)_2$$

wherein R is a cyclic hydrocarbon radical having at least 4 carbon atoms and includes terephthalic acid, isophthalic acid, cyclohexane dicarboxylic acid and anhydrides thereof. Additionally, a linear dicarboxylic acid having from 6 to 10 carbons such as, for example, adipic acid and its anhydride may be substituted for the dicarboxylic cyclic acid. The dihydric compound may be a glycol, phenol, cycloaliphatic diol, or ether diol and includes but is not limited to ethylene glycol, butane diol, neopentyl glycol, hexanediol, and other linear diols having from 2 to 10 carbons. The hydroxyl-terminated polyester can be prepared by admixing the monomers such that the dihydric compound is present in stoichiometric excess. The tricarboxylic acid anhydride includes trimellitic acid anhydride. The product has a degree of polymerization of at least 3 and a carboxyl functionality of at least three.

Acid number or value means the number of milligrams of potassium hydroxide required for neutralization of free fatty acids present in 1 gram of resin. Hydroxyl number or value, which is also called acetyl value, is a number which indicates the extent to which a substance may be acetylated; it is the number of milligrams of potassium hydroxide required for neutralization of the acetic acid liberated on saponifying 1 gram of acylated sample.

The first polyester is the reaction product of not more than about 53 weight percent, based upon the reaction mixture for the first polyester, of a benzene dicarboxylic acid such as terephthalic or isophthalic acid or mixtures thereof and an amount of a diol such as neopentyl glycol and/or cyclohexane dimethanol which is effective to provide the first polyester with a hydroxyl value in the range of about 60 to about 100.

To facilitate esterification of the dicarboxylic acid and diol, an esterification catalyst such as butylchlorotin dihydroxide, dibutyl tin oxide or hydrated monobutyl tin oxide may be used in an amount of about 0.005–0.35 weight percent of the total reaction charge.

Processing viscosities are kept relatively low to reduce reaction times. The carboxylated polyester resin has an ICI cone and plate viscosity of about 25 to about 60 poise and preferably about 30 to about 50 poise at 200° C. The first polyester has an ICI cone and plate viscosity in the range of about 8 to about 16 poise and preferably from about 10 to 12 poise at 175° C.

It is preferable that the polyester is made in two steps to keep the processing viscosity of the reaction mixture low and provide a check to monitor the extent of the reaction of acid and diol. In this embodiment the diol is reacted with only part of the acid (from about 50 to about 75 weight percent of the total acid used in the reaction) to form an oligomer. The resulting oligomer then is further reacted with the remaining acid to form the carboxyl terminated polyester. It is believed that toners of this invention obtain their charge by deprotonating in the presence of charge director micelles, which form loosely attached counterions. Carboxyl termination thus provides readily reactive sites for the formation of toner charge.

After the carboxylated polyester resin is made, it is allowed to cool and solidify. The solidified resin then is crushed or granulated. The resultant composition is cooled, rushed, finely ground and sieved.

In a preferred embodiment, the carboxyl terminated resin may be formed by copolymerizing the diol with the dicarboxylic acid, and treating the product with trimellitic acid or anhydride. The trimellitic anhydride forms an ester with the product, thereby forming two terminal carboxyl groups at each end of the polyester. Carboxyl end groups may be put on the polyester before the use of the trimellitic anhydride. An excess of acid may be left on at all times so that at the end of the reaction most of the end groups are acidic. No additional carboxylic end groups need be put on the polyester after the trimellitic anhydride has been applied. As a result, each resin chain is carboxyl terminated with two carboxyl groups at the end of each resin chain.

The carboxyl terminated resin may be blended with any suitable colorant. Suitable colorants include, but are by no means limited to, carbon black for producing a black toner; 2,9-dimethyl-substituted quinacridone and anthraquinone dye (identified in the color index as CI 60710), CI Dispersed Red 15, a diazo dye identified in the color index as CI 26050, and CI solvent Red 19 for producing a magenta toner; copper tetra-4(octadecyl sulfonamide)phthalocyanine, X-copper phthalocyanine pigment (listed in the color index as CI 74160), CI Pigment Blue, and Anthrathrene Blue, identified in the color index as CI 69810, and Special Blue X-2137, for producing a cyan toner; diarylide yellow 3,3-dichlorobenzidene acetoacetanilides, a monoazo pigment identified in the color index as Foron yellow SE/GLN, CI dispersed yellow 33, 2,5-dimethoxy-4-sulfonanilide phenylazo-4'-chloro-2,5-dimethoxy acetoacetanilide, and permanent yellow FGL for producing a yellow toner. Examples of other pigments that may be used include:

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow TY-858-D | Heubach | Yellow 74 |
| Hansa Yellow X | Hoechst | Yellow 75 |
| Novoperm ® Yellow HR | Hoechst | Yellow 75 |
| Cromophtal ® Yellow 3G | Ciba-Geigy | Yellow 93 |
| Cromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Cromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | |
| L7S-1331 Yellow | Sun Chem. | |
| L7S-2377 Yellow | Sun Chem. | |
| Hostaperm ® Orange GR | Hoechst | Orange 43 |
| Paliogen ® orange | BASF | Orange 51 |

-continued

| Pigment Brand Name | Manufacturer | Colour Index Pigment |
|---|---|---|
| Irgalite ® 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geicy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | |
| Quindo ® Red R6713 | Mobay | |
| Indofast ® Violet | Mobay | Violet 23 |
| Monastral ® Violet Maroon B | Ciba-Geigy | Violet 42 |
| Sterling ® Ns Black | Cabot | Black 7 |
| Sterling ® NSX 76 | Cabot | |
| Tipure ® R-101 | DuPont | |
| Mogul L | Cabot | |
| BK 8200 Slack Toner | Paul Uhlich | |

The pigment and the carboxyl terminated resin may be blended in any suitable manner. Preferably, they are melt blended, more preferably an extruder such as in a twin screw extruder to permit continuous production. The screw elements are configured to grind, and the pigment is broken up into sub-micron particles and dispersed into the resin. The ratio of resin to pigment to be added to be melt-blended is preferably about 80% to about 20% by weight. However, the ratio of resin to pigment may range from about 40% to about 99.9% by weight resin to about 60% to about 0.1% by weight pigment.

In a preferred twin screw extruder, there are three specific temperature zones. In the feed zone, resin, additive and pigment are metered into the extruder. The temperature is maintained below the resin melt point. If the resin begins to melt at the feed port, the entry clogs, and the extruder often stalls.

In the mixing zone, the temperature of the barrel is held just above the resin melting point, at approximately 111° C., bringing the conveyed mass to a high viscosity, molten state. Reverse directing screw elements cause the advancing blend to swirl backwards into the forward-moving blend, causing a rise in pressure. In this high energy state, pigment particles are crushed and blended into the molten resin. Pigment and optional additives mix uniformly into the liquified resin. If, during this stage, the temperature is temporarily lowered, the resin viscosity increases.

At the discharge port, the temperature is raised up to about 170° C. to fluidize the extrudate and cause it to flow freely out the exit. The pressure in the preceding mixing zone can be increased by restricting the size of the exit hole, at the expense of throughput.

The screws are preferably turned at the fastest rate which allows the molten resin to achieve the desired temperatures. Faster screw speeds provide higher energy mixing and greater throughputs, but above a certain rate, the resin is moving too fast to equilibrate with the barrel temperature, and dispersion quality degrades.

As an example, a Werner Pfleiderer WP-28 extruder equipped with a 15 horsepower motor is well-suited for melt-blending carboxyl terminated neopentyl glycol terephthalate and a pigment. This extruder has a 28 mm barrel diameter, and is considered semiworks-scale, running at peak throughputs of about 3 to 12 lbs/hour.

Dispersion quality improves when a "masterbatch" process is used. The resin is first extruded with a very high loading of pigment, for example 50% for cyan, magenta, and yellow, and 30% for black. The pigment acts as a self-grinding medium. This finished extrudate is then milled to a coarse powder and mixed, or "let down" with pure resin to lower pigment loading to the desired value. The mixture is passed through the extruder to produce the final product.

This masterbatch process is carried out in two discrete extrusions. An improved process begins as a normal batch, where a rich pigment-resin mixture is introduced at the feed port. This is melted and mixed, and at the end of the mixing zone, additional molten resin is injected into the extruder, and mixed in the next heating zone of the extruder. The product has the dispersion quality of the product of a full masterbatch process, but is delivered from the extruder at the proper pigment loading in a single pass.

Another improvement in pigment dispersion is achieved by using a chemical dispersant, such as, for example, Solsperse, an ICI product. These dispersants, which may be comprised of an alkane and a polar salt, such as copper cyanate, have no detrimental impact on the electrostatic properties of the toners. These dispersants consist, in some cases, of two components, one of which bonds strongly to the pigments, and a second which mixes well into the resin system.

In an alternative method of blending the resin and a pigment, an attritor is outfitted with an oil bath, in order to achieve high temperatures, in the range of about 150° C. to near 200° C. where most polyesters are molten. Temperature control is obtained from about 25° C. to about 300° C. with a heating bath filled with Dow Corning 210H fluid. Cooling the molten polyester seizes the attritor, as viscosity rises to an unacceptably high level. Molten viscosities of over 25 polyester resins have been measured as a function of temperature on the Bohlen rotoviscometer, and all measured 50,000 cp to 1,000,000 cp at the melting temperature. Dodecanol may be added to the mix to soften the resin, but the shaft still seizes.

Nonetheless, toner solids can be chipped out of the attritor. High quality toners are prepared from this route. If the solidified resin could be broken up in the attritor sufficiently to allow the attritor shaft to spin, an all-attritor process would be feasible. Larger, more powerful attritors impart much greater energy to the mix, and most likely would not seize.

In yet another variation of the pigmentation process, resin and pigment are mixed together dry in a high-shear mixer. If enough heat is generated, the resin softens adequately to incorporate pigment. The advantages of the process are that pigmentation and particle size reduction occur simultaneously, and the toner is prepared completely dry. The disadvantage is that pigment agglomerates are not broken down. This approach is suited to an application where color control is not critical.

A further process involves the step of dissolving the resin in a low-boiling solvent and mixing the solution with pigment. The solvent is evaporated to produce pigmented resin. This produces a very uniform mixture, but does not break down pigment agglomerates and requires a volatile solvent.

An important property of toners is brittleness which causes the resin to fracture when impacted. This allows rapid particle size reduction in attritors, other media mills, or even jet mills used to make dry toner particles.

After the resin and the pigment have been blended together, the particles of the resin-pigment mixture are reduced in size, and added to a toner dispersant. The reduction in size of the resin pigment particles may be accomplished by any number of ways including, for example, the use of attritors, pulverizers, mills, or fluidizers. Other means are also acceptable.

As an example, extruder solids can be added without post-processing to an attritor with Isopar, but larger pieces can not be taken into the media. It is thus preferable to pregrind large pellets in a mill such as a hammer mill to produce a coarse powder, which then mixes readily into the attritor media. With a fine pelletizer at the extruder output, the coarse grind step may be eliminated.

Horizontal mills from Premier and Netzsch and vertical mills from Drais may be used to reduce particle size, all with excellent results. Coarse toner slurry is pumped into these mills, and backing pressure forces the material to advance through the media and out an exit port. The Netzsch mill reduces particle size faster than the Premier mill. The Drais mill is much larger, and produces toner at higher throughput.

The concentration of the toner slurry, the rpms (revolutions per minute) of the shaft of the mill, the media size and the residence time all affect the efficiency of attritors in grinding the toner particles. Best results are achieved with high slurry concentration, high shaft rpm, 0.5 mm media, and about 3 to about 10 minute residence times.

The toner particle size can also be reduced in a liquid jet interaction chamber, of the general description disclosed in U.S. Pat. No. 4,533,254, which is hereby incorporated by reference. A preferred apparatus is the MICROFLUIDIZER® emulsifier, available from Microfluidics Corporation in Newton, Mass. However, there can be no particles larger than about 100 μm in diameter in the feed slurry or the interaction chamber of the fluidizer clogs. As an example, Cargill 3051 cyan toner is reduced in size in the 7500 psig Lab-Scale Microfluidizer. The solids are first processed through a Thomas Wiley mill with the smallest screen in place and the resulting fine powder is mixed into Isopar at 10% solids with 50mg/g BBP (Basic Barium Petronate). The mean average size of the polyester toner particles is reduced from 29.5μ, to 6.5μ after microfluidization.

After particle size reduction, the toner particles have an average particle size of less than 30μ, preferably less than 15μ, more preferably less than 10μ, as measured using a Malvern 3600E Particle Sizer® manufactured by Malvern, Southborough, Mass., which uses laser diffraction light scattering of stirred samples to determine average particle sizes. Various instruments are known to measure particle size in addition to the Malvern instrument, such as the Horiba CAPA-500® centrifugal particle analyzer, manufactured by Horiba Instruments, Inc., Irvine, Calif. In determining particle size by area, a solvent viscosity of 1.24 cps, solvent density of 0.76 g/cc, sample density of 1.32 using a centrifugal rotation of 1,000 rpm, a particle size by area range of 0.01 to less than 10 μm, and a particle size by area cut of 1.0 μm are used.

Since these two instruments use differing techniques to measure average particle size, the readings differ. The following correlation of the average size of toner particles in micrometers for the two instruments is:

| Value Determined By Malvern 3600E Particle Sizer | Expected Range For Horiba CAPA - 500 |
|---|---|
| 30 | 9.9 ± 3.4 |
| 20 | 6.4 ± 1.9 |
| 15 | 4 6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification, the particle size values are as measured using the Malvern instrument.

Following the reduction of the toner particle size, the resin, which in most size reduction processes has been added to a toner dispersant, is concentrated to between about 50% to about 100% to form a high solids developer concentrate. There are a number of processes to increase the concentration of the resin in the developer, including, for example, vacuum and/or pressure filtering, alkane washing and filtering, centrifugation and gentle heating.

For example, the toner dispersion may initially, after the reduction of the toner particle size, be vacuum filtered to form a wet cake. In an alternative method, the toner may be pressure filtered. An initial filtering may result in a solids concentration of about 40% to about 50% or greater.

This cake may be mixed with an alkane such as hexane or some other low-boiling fluid in which the resin is insoluble. The resulting dispersion is vacuum filtered and dried, for example air dried. A solids content of greater than about 95% may be routinely achieved by this procedure. The percent solids is determined by baking a known mass of toner to complete dryness and measuring the weight lost.

In a variation of this method for concentrating the toner, the toner dispersant mixture is centrifuged to form a centrifuged dispersant mixture. The supernatant of the centrifuged dispersant mixture is replaced with a low boiling fluid such as hexane to form an alkane mixture. The mixture is centrifuged, thereby separating a concentrated toner mass from the fluid. The remaining fluid is removed from the concentrated toner mass, preferably by vacuum or pressure filtering and air drying of the concentrated toner mass. It is possible to achieve a solids composition of greater than about 95% by this procedure.

Since image formation depends on the differences of the charge between the liquid developer and the latent electrostatic image to be developed, it is desirable to add a charge director and/or an adjuvant. As an example, adjuvants which can be melt blended with the resin can be selected from the group consisting of a polyhydroxy compound which contains at least 2 hydroxy groups, aminoalcohol, polybutylene succinimide, metallic soap, and aromatic hydrocarbon having a Kauributanol value of greater than 30. The adjuvants are generally used in an amount of 1 to 1000 mg/g, preferably 1 to 200 mg/g developer solids. Examples of the various above described adjuvants include:

polyhydroxy compounds: ethylene glycol, 2,4,7,9-tetramethyl-5-decyn-4,7-diol, poly(propylene glycol), pentaethylene glycol, tripopylene glycol, trimethylene glycol, glycerol, pentaerythritol, glycerol-tri-12 hydroxystearate, ethylene glycol monohydroxystearate, propylene glycerol monohydroxystearate, etc. as described in Mitchell U.S. Pat. No. 4,734,352.

aminoalcohol compounds: triisopropanolamine, triethanolamine, ethanolamine, 3-amino-1-propanol, o-aminophenol, 5-amino-1-pentanol, tetra(2-hydroxyethyl) ethylenediamine, etc. as described in Larson U.S. Pat. No. 4,702,985.

polybutylene/succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

metallic soap: aluminum tristerate; aluminum distearate; barium, calcium, lead and zinc stearate; cobalt, manganese, lead and zinc linoleates; aluminum, calcium and cobalt octoates; calcium and cobalt oleates; zinc palmitate; calcium, cobalt, manganese, lead and zinc naphthenates; calcium, cobalt, manganese, lead and zinc resinates; etc. The metallic soap is dispersed in the thermoplastic resin as described in Trout U.S. Pat. Nos. 4,707,429 and 4,740,444 and is an additive. The metallic soap can be present in an amount of 0.01 to 60% in weight based on the total weight of solids.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of C9 and C10 Alkyl-substituted benzenes manufactured by Exxon Corp., etc. as described in Mitchell U.S. Pat. No. 4,631,244.

The disclosures of the above-listed United States patents describing the adjuvants are incorporated herein by reference.

To acquire a negative or positive charge from a chemical dissociation reaction on the toner particles, a charged species may be introduced in the carrier liquid to form a counterion. A charge director in the liquid developer influences or is responsible for electrical charging of the toner. The charge director may have a positive or negative charging effect. Mostly oil-soluble ionogenic substances (surfactants), e.g., metallic salts of organic acids with long aliphatic chains (e.g., containing at least 6 carbon atoms), are used for that purpose. By predominant adsorption of one ionic species, the toner particles receive a net charge whose amount can be regulated by changing the additive concentration. In this way the sensitivity of the toner (i.e., deposited mass per surface charge) can be controlled. The polarity can be determined by appropriate choice of the surfactant. Mixtures of different charge directors can be used. For example, a mixture of different charge directors having opposite charging effects can be used so that the strength of the charge on the toner or the polarity thereof can be adjusted by varying the ratio between the different charge directors.agents. Particularly suitable positively working charge directors are bivalent or trivalent metal salts of:

(a) a monoester or diester of an oxyacid derived from phosphorus;

(b) an oxyacid derived from phosphorus and containing one or two organic groups linked to the phosphorus atom by a carbon atom; or (c) an oxyacid derived from phosphorus and containing an ester group and an organic group linked by a carbon atom to the phosphorus atom, the organic group being aliphatic, cycloaliphatic or aromatic.

The organic groups preferably comprise a chain of at least 4 carbon atoms, most preferably from 10–18 carbon atoms, and such a chain may be substituted and/or interrupted by hetero-atom(s), e.g. oxygen, sulphur, or nitrogen atom(s).

Particularly good results are obtained with barium salts. However, other salts may be used, e.g. magnesium salts, calcium salts, strontium salts, zinc salts, iron salts, cobalt salts, nickel salts, copper salts, cadmium salts, aluminum salts, and lead salts.

The solubility in the electrically insulating carrier liquid of such metal salts can be promoted by the presence of one or more organic groups with a branched structure, e.g., branched aliphatic groups, such as a 2-butyl-octyl group.

In a preferred embodiment, particularly useful or effective positively charged charge directors that are of special interest in the production of an electrophoretic developer with low charge/toner particle mass ratio are metal alkyl sulphonates in which the metal ion is a bivalent metal ion selected from the group consisting of zinc(II), lead(II), cadmium(II), copper(II) and barium (IIA), or is a trivalent metal ion of the Periodic Table of the Elements, e.g., iron (III), or of the group VIB, e.g., chromium(III), and in which the sulphonate group is present directly on an alkyl chain containing at least 6 carbon atoms in a straight line.

A suitable amount of the sulphonate for a given developer can be easily determined by simple tests. By using a metal alkyl sulphonate as a charge control agent the specified results can be achieved with toner particles of a size commonly used in the electrophotographic art, e.g., with toner particles in the range of 0.2 to 2 μm. An additional charge director can be used in conjunction with the metal alkyl sulphonate, but this is not a requirement to charge the liquid resin toner.

Sufficient carrier fluid may be added to the concentrate (or vice versa) to achieve a liquid developer with a working strength concentration of the toner resin. The toner resin may be redispersed in the carrier fluid by, for example, sonicating the resin in a desired amount of carrier fluid, for example for about 3–8 minutes. The toner resin may also be sonicated in a standard laboratory ultrasonic bath. Alternatively, the toner can also be redispersed with a point sonicator. Other methods of sonication or redispersion may be used to achieve the desired concentration.

As an example of a preferred embodiment of the present invention, the surfactant Basic Barium Petronate from Witco is used as a charge director. Barium Petronate is a barium salt of an alkane chain 16–20 carbons long with a sulfonate ($SO_3^{-2}$) attached to the end of the alkane chain. The Barium Petronate may be first mixed in with the toner resin dispersion after particle size reduction by an attritor or microfluidizer but prior to formation of a wet cake of toner resin. Approximately 15 mg of charge director are added per gram of toner resin. After the toner resin has been redispersed to about 1% solids, additional Barium Petronate may be added at the rate of about 15 mg of charge director per gram of toner resin. The amount of charge director which may be added to the toner resin ranges from about 15 mg of charge director to about 1 gram of charge director per gram of toner resin, with the optimum range of charge director being about 15 mg to about 150 mg, with 15 mg being the preferred amount of charge director added per gram of toner resin. Conductivity of the liquid developer should be about 10 pmho/cm.

Other charge directors which may be used with this resin include positive charge directors, e.g., anionic glycerides such as Emphos® D70-30C, Emphos® F27-85, etc., manufactured by Witco Chem. Corp., New York, N.Y.; sodium dioctylsulfosuccinate (manufactured by American Cyanamid Co.); ionic charge directors such as zirconium octoate, copper oleate, iron naphtenate, etc.; and nonionic charge directors such as polyethylene glycol sorbitan stearate.

While the invention has been described with reference to the structures and embodiments disclosed herein, it is not confined to the details set forth, and encompasses such modifications or changes as may come within the purpose of the invention.

EXAMPLES

For the purposes of the preparation of the developer described below, the carboxyl terminated neopentyl glycol terephthalate was obtained from Cargill (Cargill 3051).

These examples demonstrate that toners of the present invention can be highly concentrated and readily redispersed into a viable working strength developer.

COMPARATIVE EXAMPLE DEVELOPERS 1-3

Resin, colorant, additive, and a nonpolar liquid are added to a 1S attritor (by Union Process). The temperature of the mixture is brought to 95° C. to 105° C. by running steam through the jacket. The mixture is ground at a rotor speed of 125 RPM for 1 hour. 512 grams of Isopar® L are then added to the mixture, and the temperature of the mixture is reduced to 15° C. to 25° C. by running cold water through the jacket. The rotor speed is increased to 250 RPM and the mixture is ground for 2.0 hours at the reduced temperature. 1000 grams of Isopar L are then added to the attritor and the product is recovered. Percent solids of the resulting toner concentrate is determined by evaporating a known mass to dryness. The toner is weighed and the total solids calculated. Witco Basic Barium Petronate® (BBP) charge director is then added to the developer to a level of 10 mg charge director per gram total solids. The solids concentration of the developer is then adjusted to 10% by adding Isopar® L.

| | |
|---|---|
| Comparative Example 1 | |
| Nucrel® 599 (a methacrylic and ethylene resin) | 236.2 g |
| BASF Lithol® Scarlet NBD 4455 | 59.2 g |
| Witco 133 Aluminum Stearate | 3.0 g |
| Isopar® L | 1000.0 g |
| Comparative Example 2 | |
| Nucrel® 599 | 236.2 g |

-continued

| | |
|---|---|
| Sun L74-1357 resin-free Yellow | 59.2 g |
| Witco 133 Aluminum Stearate | 3.0 g |
| Isopar® L | 1000.0 g |
| Comparative Example 3 | |
| Nucrel® 599 | 236.2 g |
| Heliogen® Blue NBD 7010 | 59.2 g |
| Witco 133 Aluminum Stearate | 3.0 g |
| Isopar® L | 1000.0 g |

EXAMPLES 1-3

Resin, colorant and additive are melt-blended in a Werner-Pfleiderer WP-28 twin screw extruder set to the following nominal conditions.

| | |
|---|---|
| RPM | 300 |
| Feed temperature | ambient |
| Mixing zone temperature | 90°-120° C. |
| Discharge port temperature | 150°-180° C. |
| Die dimensions | 3/32" × ⅛" |
| Make rate | 5-11 lb./hour |

Toner solids are prepared using a two-stage masterbatch process. In the first stage, pigment and additives make up 50% of the composition, as follows.

| | |
|---|---|
| Example 1 Masterbatch | |
| Cargill 30-3051 resin | 50.0 parts |
| BASF Lithol Scarlet® NBD 4455 | 45.5 parts |
| Witco 133 Aluminum Stearate | 4.5 parts |
| Example 2 Masterbatch | |
| Cargill 30-3051 resin | 50.0 parts |
| Sun L74-1357 resin-free Yellow | 45.5 parts |
| Witco 133 Aluminum Stearate | 4.5 parts |
| Example 3 Masterbatch | |
| Cargill 30-3051 resin | 50.0 parts |
| Heliogen® Blue NBD 7010 | 40.9 parts |
| ICI Solsperse® 24000 | 3.4 parts |
| ICI Solsperse® 5000 | 1.2 parts |
| Witco 133 Aluminum Stearate | 4.5 parts |

The Masterbatch material is extruded, then granulated and mixed with sufficient resin to bring the pigment and additive to 22% of the total solids, as follows:

| | |
|---|---|
| Example 1 Extrudate | |
| Example 1 Masterbatch | 44.0 parts |
| Cargill 30-3051 resin | 56.0 parts |
| Example 2 Extrudate | |
| Example 2 Masterbatch | 44.0 parts |
| Cargill 30-3051 resin | 56.0 parts |
| Example 3 Extrudate | |
| Example 3 Masterbatch | 44.0 parts |
| Cargill 30-3051 resin | 56.0 parts |

PREPARATION OF 10% SOLIDS CONCENTRATE

The mixtures above are extruded and granulated. 800 grams of each product are added to a Union Process 1S attritor with 1485 grams of Isopar® L. This mixture is milled at 300 RPM for 2 to 4 hours, then recovered. Witco Basic Barium Petronate® (BBP) charge director is then added to a level of 10 mg charge director per gram toner solids and the solids concentration of the developer is adjusted to 10% by adding Isopar® L.

The solids composition of each of the developers is as follows:

| | |
|---|---|
| Example 1 | |
| Cargill 30-3051 resin | 78.0 parts |
| BASF Lithol Scarlet ® NBD 4455 | 20.0 parts |
| Witco 133 Aluminum Stearate | 2.0 parts |
| Example 2 | |
| Cargill 30-3051 resin | 78.0 parts |
| Sun L74-1357 resin-free Yellow | 20.0 parts |
| Witco 133 Aluminum Stearate | 2.0 parts |
| Example 3 | |
| Cargill 30-3051 resin | 78.0 parts |
| Heliogen ® Blue NBD 7010 | 18.0 parts |
| ICI Solsperse ® 24000 | 1.5 parts |
| ICI Solsperse ® 5000 | 0.5 parts |
| Witco 133 Aluminum Stearate | 2.0 parts |

Each of the developers (Comparison Example Developers 1-3 and Example Developers 1-3) is then diluted from 10% solids to normal working strength concentration. Particle size and mobility are tested.

The 10% solids concentrates are then dried to very high percent solids and peak solids concentrations are measured. To simulate replenishment in a printing machine, the toners are diluted to a working strength concentration, conductivity is adjusted, and the diluted developers are redispersed for 5 minutes in a Cole-Parmer bath sonicator. The properties of the toners redispersed from very high percent solids are then measured and compared against toners redispersed from 20% solids. This is performed as follows:

REDISPERSION FROM 10% SOLIDS 100 grams of 10% toner solids concentrate are diluted with 900 grams of Isopar ® L to make 1 liter of a 1.0% solids concentrate, which is normal working strength. The conductivity is adjusted to 10 pmho/cm by adding 10% BBP dropwise.

Particle size is measured with a Malvern 3600E particle sizer, which gives the size of the particles in the 50th percentile (V50) and the size of the particles in the 90th percentile (V90) in each sample. As discussed earlier, particles sizes from the Malvern 3600E are about three times larger than actual particle size, but the numbers are useful for comparison. The electrophoretic mobility is measured with an Electrokinetic Sonic Analyzer by Matec, Hopkinton, Mass. Mobilities are reported in $10^{10}$ $m^2$/Volt-Sec. These measurement are tabulated below under the heading "Redispersed from 10% Solids".

CONCENTRATION PROCEDURE 500 grams of 10% toner solids concentrate are vacuum filtered. The filtered solids are then redispersed in about 200 grams of n-hexane by shaking lightly. The hexane dispersion is then vacuum filtered and dried overnight at room temperature. The percent solids of the product is determined and tabulated below as "Peak % Solids".

REDISPERSION FROM VERY HIGH PERCENT SOLIDS

The dried toner solids are added to a sufficient amount of Isopar ® to produce a 1% toner solids liquid developer. Conductivity is adjusted to 10 pmho/cm by adding BBP, and the developer is sonicated 5 minutes in a Cole-Parmer ultrasonic bath. The particle size and electrophoretic mobility are measured as described above. Results are tabulated below under the heading "Redispersed from Peak % Solids".

| | Redispersed from 10% Solids | | | | Redispersed from Peak % Solids | | |
|---|---|---|---|---|---|---|---|
| | particle size (μ) | | mobility | Peak % Solids | particle size (μ) | | mobility |
| | V05 | V90 | | | V50 | V90 | |
| Example 1 | 7.0 | 21.0 | 9.2 | 98.1 | 3.3 | 6.3 | 17.2 |
| Comparative Example 1 | 9.6 | 25.3 | 7.8 | 99.0 | 11.0 | 37.8 | 14.8 |
| Example 2 | 4.8 | 10.8 | 7.2 | 98.3 | 4.9 | 17.0 | 3.6 |
| Comparative Example 2 | 5.0 | 8.3 | 9.6 | 99.8 | 26.4 | 89.2 | 3.4 |
| Example 3 | 5.3 | 14.2 | 3.5 | 97.3 | 16.1 | 70.8 | 4.0 |
| Comparative Example 3 | 5.9 | 12.4 | 16.8 | 87.7 | >100 | >100 | * |

| | |
|---|---|
| Comparative Example 4 | |
| Nucrel ® 599 | 236.2 g |
| Cabot Monarch ® 1000 | 59.2 g |
| Witco 133 Aluminum Stearate | 3.0 g |
| Isopar ® L | 1000.0 g |
| Prepare as in Examples above | |
| Example 4 | |
| Cargill 30-3051 resin | 78.0 parts |
| Cabot Monarch ® 1000 | 20.0 parts |
| Witco 133 Aluminum Stearate | 2.0 parts |

*Unmeasurable due to clumping
Units for mobility: E10 sqm/volt-sec

Predicted results are as follows:

| | Redispersed from 10% Solids | | | | Redispersed from Peak % Solids | | |
|---|---|---|---|---|---|---|---|
| | particle size (μ) | | mobility | Peak % Solids | particle size (μ) | | mobility |
| | V05 | V90 | | | V50 | V90 | |
| Example 4 | 5 to 10 | 10 to 30 | 3 to 10 | 95 to 99 | <10 | <30 | 3 to 20 |
| Comparative Example 4 | 5 to 10 | 10 to 30 | 5 to 20 | 85 to 99 | >30 | >40 | 3 to 20 |

The results above demonstrate that the toners of this invention can be concentrated to virtual dryness and redispersed with mild sonication to working strength concentration. The Comparative Example toner redisperse adequately from a 10% concentrate, but redispersing such toners from near dryness in all cases leads to less desirable particle sizes.

| | |
|---|---|
| Comparative Example 5 | |
| Nucrel ® 599 | 105.6 g |
| Heliogen Blue NBD 7010 | 12.0 g |
| Witco 22 Aluminum Stearate | 2.4 g |
| Isopar ® L | 330.0 g |

The materials are added to a Union Process 200S attritor and ground at 80° C. for 1 hour. 150 grams of Isopar ® are then added to dilute the mixture to approximately 20% solids, and the temperature is reduced to about 30° C. The mixture is ground an additional 2 hours. 200 grams of Isopar ® L is added to reduce the concentration to about 15 percent solids and recirculation is begun. Recirculation exchanges material from the bottom to the top of the attritor to produce more uniform grinding. The mixture is then ground for 6 hours at about 30° C. The concentrate is discharged, diluted to 10% solids, and 10 parts per thousand of toner solids of Witco Basic Barium Petronate® is added.

EXAMPLE 5

The following ingredients are added to a Union Process 01 attritor.

| | |
|---|---|
| Cargill 30-3051 resin | 46.8 grams |
| Heliogen ® Blue NBD 7010 | 12.0 grams |
| Witco 22 Aluminum Stearate | 1.2 grams |
| Isopar L | 240.0 grams |

The jacket of the attritor is attached to a temperature-controlled oil bath containing Dow-Corning 210H Fluid. The attritor is heated to 175° C. and the mixture is milled for 1 hour at 200 RPM. The attritor is stopped and cooled to room temperature. The pigmented resin solidifies. The solid mass is removed from the attritor, pulverized, diluted to 20% solids, and is reintroduced into the attritor. Milling continues at 300 RPM for 18 hours at about 25° C. The resulting concentrate is recovered and 10 mg of BBP are added per gram toner solids. The toners prepared above are pressured filtered with a Larox piston press at 60 psi. The toners are filtered until the flow of carrier fluid ceases.

This example demonstrates that toners of this invention can be readily concentrated in a piston press.

EXAMPLE 6

This example demonstrates that toners of this invention redisperse readily.

The moist cakes at 40%–50% solids prepared in Example 5 are diluted to 10% solids and redispersed with an Omin homogenizer for varying periods of time. Particle size as a function of homogenization time is shown in the table below. Particle sizes are measured with a Malvern 3600E particle sizer. The toner of this invention reaches goal particle size much faster than the Comparative Example, and is reduced to a particle size smaller than the goal in the first timed sample.

| | Size Percentile | Size (μ) Before Filtering | Size (μ) After Filtering Vs. Homogenization Time | | | |
|---|---|---|---|---|---|---|
| | | | 0.5 min. | 1 min. | 3 min. | 6 min. |
| Comparative Example 5 | V50 | 5.8 | 7.8 | 7.9 | 8.0 | 7.2 |
| | V90 | 12.8 | 53.2 | 51.5 | 36.9 | 33.1 |
| Example 5 | V50 | 5.1 | 3.3 | 3.2 | 3.1 | 3.2 |
| | V90 | 11.4 | 11.4 | 7.8 | 7.2 | 8.8 |

EXAMPLES 7–10

These examples demonstrate that toners of this invention can be used to print high quality color images using a liquid developer color copier. The following ingredients are added to a Union Process 01 attritor.

| | |
|---|---|
| Example 7 | |
| Cargill 30-3051 resin | 48.0 grams |
| BASF Lithol Scarlet ® NBD 4455 | 12.0 grams |
| Isopar ® L | 240.0 grams |
| Example 8 | |
| Cargill 30-3051 resin | 48.0 grams |
| Sun L74-1357 resin-free Yellow | 12.0 grams |
| Isopar ® L | 240.0 grams |
| Example 9 | |
| Cargill 30-3051 resin | 48.0 grams |

-continued

| | |
|---|---|
| Heliogen ® Blue NBD 7072D | 12.0 grams |
| Isopar ® L | 240.0 grams |
| Example 10 | |
| Cargill 30-3051 resin | 48.0 grams |
| Cabot Monarch ® 1000 | 12.0 grams |
| Isopar ® L | 240.0 grams |

The jacket of the attritor is piped to a temperature-controlled oil bath containing Dow-Corning 210H Fluid. The attritor is heated to 175° C. and the mixture is milled for 1 hour at 200 RPM. The attritor is stopped and cooled to room temperature. The pigmented resin solidifies. The solid mass is removed from the attritor, pulverized, diluted to 20% solids, and reintroduced into the attritor. Milling continues at 300 RPM for 18 hours at about 25° C. The resulting concentrate is recovered, and 10 mg of BBP are added per gram of toner solids. The product is concentrated to a 90%–95% solids level as described in Examples 1–4, diluted to working strength concentration and sonicated 5 minutes. 100 mg BBP is then added per gram toner solids. The developer is held at room temperature for three days to allow conductivity to stabilize. Conductivity and mobility are then measured. The results are shown below.

| | Conductivity (pmho/cm) | Mobility ($10^{10}$ $m^2$/Vol-sec) |
|---|---|---|
| Example 7 | 23 | 4.5 |
| Example 8 | 26 | 6.9 |
| Example 9 | 11 | 4.3 |
| Example 10 | 25 | 4.7 |

The developers are used to print four-color pictures using a Fuji-Xerox 6800 color copier modified to use liquid developer. Four toning stations, each with an electrically biased toning shoe and an electrically biased metering roll, are installed around the selenium-alloy photoconductor drum. The copier has also been retrofitted with a 600 spot per inch HeNe rotating polygon laser exposure unit. Image information is transmitted to the printer from a proprietary raster image processor.

Good quality four color prints are obtained on both Xerox 4024 plain paper (from Xerox Corporation, Rochester, N.Y.) and Plainwell Solitaire® smooth printstock (from Plainwell Paper Co., Plainwell, Mich.).

EXAMPLE 11

This example demonstrates that developers of this invention can be used to print high resolution images. This example also demonstrates that developers of this invention transfer well to a receiver sheet under a wide range of electrostatic transfer settings.

800 grams of the granulated cyan extrudate described in Example 3 are added with 1485 grams Isopar ®L to 1S attritor by Union Process. This material is milled at about 25° C. at 300 RPM for 3 hours. The concentrate is recovered, and is used to prepare 5 liters of 2% solids developer with 20 mg/g BBP added. Conductivity is then adjusted to 15 pmho/cm by adding BBP.

The resolution capabilities of the developer are evaluated on a single-color testbed using photopolymer master material (as disclosed in Riesenfeld et al., U.S. Pat. No. 4,732,831) as the photoreceptor. The photopolymer master is exposed imagewise with an ultraviolet source through a silver halide transparency bearing an image pattern. This renders the exposed areas resistive, while the unexposed areas remain conductive. The photopolymer is then mounted on a steel drum, and the conductive backing of the film is grounded to the drum.

The drum rotates at 2.2 inches/second. The photopolymer master is charged to a surface voltage of +320 volts with a scorotron, and the charge decays to background levels in the unexposed, conductive areas, thus forming a latent electrostatic image. This image is developed 3.6 seconds after charging, using a pair of biased roller toning electrodes gapped 0.010 inches from the photopolymer surface and rotated at 3.9 inches/-second in the direction of the drum rotation through which the liquid developer is delivered. The developed image is metered with a 1.5 inch diameter steel roller gapped 0.004 inches from the photopolymer, rotated at 4.7 inches/second in the opposite direction of the drum rotation and biased to +180 volts. The developed image is then transferred to Plainwell Solitaire® paper at 2.2 inches/second through a transfer zone defined at the lead edge by a biased conductive rubber roller and at the trail edge by a corotron. The roller bias is set to −2500 volts, the corotron current is set to 10 μamp, and the corotron housing is grounded. The paper is tacked to the surface of the photopolymer by the biased conductive rubber roller, and the motion of the drum pulls the paper through the transfer zone. The image is fused for minute in a drying oven at 200° C.

An excellent image is obtained. Solid areas are uniform, text appears crisp, and 2% to 98% dots are printed cleanly from 150 line UGRA resolution target.

It is common for printed resolution to degrade if tack-down bias and corotron current are not balanced properly. The ability of a developer to transfer crisply under varying electrostatic conditions is termed transfer latitude. The transfer latitude of the developer of this invention is tested against Comparative Example Developer 5. It is first verified that Comparative Example Developer 5 prints an excellent image with roller bias set to −2500 volts and corotron current set to 10 μamp. The transfer conditions are mistuned to −1000 volts roller bias and 25 μamp corotron current. The Comparative Example Developer 5 smears during transfer, while the developer of Example 9 transfers with only a trace of smear. The developer of Example 9 thus displays excellent transfer latitude.

EXAMPLE 12

This example demonstrates that the developer of the invention contains less carrier fluid in the developed image.

This example compares Comparative Example 5 with Example 5 and Comparative Example 2 with Example 2.

Developers are diluted to 2% toner solids and conductivity is adjusted to 5–10 pmho/cm. The developers are plated onto a removable electrode in a DC cell with an one mm electrode gap and an one square inch electrode area. The field is set to 1 volt/micron, which mimics development fields in copiers. Excess carrier fluid is drained from the electrode, and the percent solids of the developed patch is determined by evaporating the sample to dryness. The percent solids is tabulated below.

| Toner | Percent Solids |
|---|---|
| Comparative Example 2 | 15 |

-continued

| Toner | Percent Solids |
|---|---|
| Example 2 | 25 |
| Comparative Example 5 | 15 |
| Example 5 | 24 |

EXAMPLE 13

This example demonstrates that developers of the current invention develop to a thinner image.

This example compares Comparison Example 5 against Example 11.

The developers are placed in a flow cell containing a pair of electrodes separated by a 1 mm gap, viewed from the side by a microscope which is equipped with a video camera and video recorder. A 1 volt/micron field is applied across the electrodes, and toner plates onto the cathode. When viewed at 250X magnification, it can be easily seen that the toner of Example 11 plates with a more compact layer, approximately ⅓ as thick, as the toner of Comparative Example 5. This thinner layer would be expected to entrap less carrier fluid.

What is claimed is:

1. A method for producing a high solids replenishable electrostatic liquid developer concentrate, comprising:

blending particles containing a carboxyl terminated polyester and a pigment with a liquid toner dispersant to form a toner dispersant mixture and to increase the solids content of the toner dispersant mixture to more than about 90% solids.

2. The method according to claim 1, wherein said carboxyl terminated polyester is terminated with a trimellitic acid group.

3. The method according to claim 1, wherein said polyester is a reaction product of a diol and a dicarboxylic acid having from 4 to 10 carbon atoms or an anhydride thereof.

4. The method according to claim 3, wherein said diol is selected from the group consisting of linear diols having from 2 to 10 carbon atoms, neopentyl glycol and cyclohexanediol, and said dicarboxylic acid is selected from the group consisting of terephthalic acid, isophthalic acid, cyclohexane dicarboxylic acid, adipic acid, and anhydrides thereof.

5. The method according to claim 1, further comprising reducing the size of said particles in said toner dispersant mixture to form a reduced particle size toner dispersant mixture.

6. The method according to claim 5, wherein the size of said particles is reduced to between about 0.5 to about 10 microns.

7. The method according to claim 5, wherein the size of said particles is reduced by grinding said toner dispersant mixture.

8. The method according to claim 7, wherein an emulsifier is used to grind the toner dispersant mixture.

9. The method according to claim 5, wherein the size of the particles is reduced in an attritor.

10. The method according to claim 5, wherein the size of the particles is reduced in an extruder.

11. The method according to claim 1, further comprising increasing a solids content of said toner dispersant mixture.

12. The method according to claim 1, wherein the toner dispersant mixture is centrifuged to form a centrifuged dispersant mixture.

13. The method according to claim 12, wherein liquid toner dispersant of said toner dispersant mixture is replaced with a low boiling alkane to form an alkane mixture, and said alkane is separated from said alkane mixture to produce a concentrated toner mass.

14. A high solids replenishable electrostatic liquid developer concentrate comprising:

toner particles containing a carboxyl terminated polyester resin and a pigment; and a liquid toner dispersant said concentrate having more than about 90% solids.

15. The developer concentrate according to claim 14, wherein said carboxyl terminated polyester is terminated with a trimellitic acid group.

16. The developer concentrate according to claim 14, wherein said polyester is a reaction product of a diol and a dicarboxylic acid having from 4 to 10 carbon atoms or an anhydride thereof.

17. A high solids replenishable electrostatic liquid developer concentrate comprising:

toner particles containing a carboxyl terminated polyester resin and a pigment; and a liquid toner dispersant, wherein a solids content of said concentrate is above about 50%.

18. The developer concentrate according to claim 14, wherein said toner particles have an average particle size of from about 0.5 micron to about 10 microns.

19. The developer concentrate according to claim 14, further comprising a charge director.

20. The developer concentrate according to claim 19, wherein said charge director is a metallic salt of an organic acid.

21. The developer concentrate according to claim 19, wherein said charge director is a metallic salt of a monoester or diester of an oxyacid selected from the group consisting of an oxyacid derived from phosphorus, an oxyacid derived from phosphorus and containing one or two organic groups linked to the phosphorus atom by a carbon atom, and an oxyacid derived from phosphorus and containing an ester group linked by a carbon atom to the phosphorus atom; a metal alkyl sulphonate; or lecithin.

22. The developer concentrate according to claim 14, wherein a fine particle size inorganic oxide is blended with the resin.

23. The developer concentrate according to claim 14, wherein the toner particles have dispersed therein a metallic soap.

24. The developer concentrate according to claim 23, wherein the metallic soap is aluminum tristearate.

25. A method of replenishing toner solids in a liquid electrostatic developer in a liquid electrostatographic printing machine, comprising adding toner particles containing a carboxyl terminated polyester resin and a colorant in a liquid concentrate having a solids content greater than 90% to a toner solids depleted liquid electrostatic developer in said machine.

26. The method according to claim 25, wherein said toner particles are added in a substantially dry state to said electrostatic developer.

27. The developer according to claim 25, wherein the toner particles have an average particle size of from about 0.5 micron to about 10 microns.

28. The method according to claim 25, wherein the toner particles have an average particle size of from about 0.5 micron to about 10 microns.

* * * * *